United States Patent [19]

Thuries et al.

[11] Patent Number: 4,774,388

[45] Date of Patent: Sep. 27, 1988

[54] COMPRESSED DIELECTRIC GAS CIRCUIT BREAKER

[75] Inventors: Edmond Thuries, Pusignan; Denis Dufournet, Bron, both of France; Satoru Yanabu, Tokyo, Japan; Michel Perret, Tramole, France

[73] Assignee: Alsthom, Paris, France

[21] Appl. No.: 30,304

[22] Filed: Mar. 26, 1987

[30] Foreign Application Priority Data

Mar. 26, 1986 [FR] France ..... 86 04393

[51] Int. Cl.[4] ..... H01H 33/88

[52] U.S. Cl. ..... 200/148 A; 200/148 B

[58] Field of Search ..... 200/148 A, 148 B

[56] References Cited

U.S. PATENT DOCUMENTS 4,649,243 3/1987 Thuries ..... 200/148 A 4,650,941 3/1987 Thuries et al. ..... 200/148 A

*Primary Examiner*—Robert S. Macon

*Attorney, Agent, or Firm*—Sughrue, Mion, Zinn, Macpeak & Seas

[57] ABSTRACT

A compressed gas dielectric circuit breaker comprising fixed main contacts (11), fixed arcing contacts (8A), a moving assembly comprising main contacts (21) and arcing contacts (22A), a blast device comprising a semi-moving cylinder (16) divided into first and second chambers (15, 35) by a fixed piston (3B), with the first chamber (15) communicating with a blast nozzle (12), and a thermal volume (9) opening out into the zone where the fixed arcing contacts (8A) separate from the arcing contacts (22A) of the moving assembly, communication (26) being established between the thermal volume (9) and said second chamber (35) in order to enable gas heated by the arc in the thermal volume to increase in pressure and to assist in the displacement of the cylinder (16) and thus in the compression of the gas in the first chamber (15).

4 Claims, 7 Drawing Sheets

COMPRESSED DIELECTRIC GAS CIRCUIT BREAKER

The present invention relates to a compressed dielectric gas circuit breaker of the type comprising a compression volume and a thermal volume.

The term "compression volume" is used to designate a volume in which the gas is compressed by a piston and from which the compressed gas is directed onto the arc which forms when the arcing contacts separate.

The term "thermal volume" is used to designate a volume in which the gas heats up under the action of the circuit -breaking arc, and whose pressure therefore rises.

The thermal energy obtained in this way is used for compressing the blast volume, thereby reducing the energy required to operate the circuit breaker.

BACKGROUND OF THE INVENTION

A circuit breaker of this type is described in U.S. Pat. No. 4,486,632. However, in that circuit breaker, the hot gases from the thermal volume are mixed with the cold gases in the blast volume, thereby reducing their extinguishing power.

An aim of the present invention is to provide a circuit breaker which avoids this drawback.

SUMMARY OF THE INVENTION

The present invention provides a compressed gas dielectric circuit breaker comprising fixed main contacts, fixed arcing conctacts, a moving assembly comprising main contacts and arcing contacts, a blast device comprising a semi-moving cylinder divided into first and second chambers by a fixed piston with the first chamber communicating with a blast nozzle, and a thermal volume opening out into the zone where the fixed arcing contacts separate from the arcing contacts of the moving assembly, with communication being established between the thermal volume and said second chamber in order to enable gas heated by the arc in the thermal volume to increase in pressure therein and to assist in the displacement of the cylinder and thus in the compression of the gas in the first chamber.

BRIEF DESCRIPTION OF THE DRAWINGS

Embodiments of the invention are described by way of example, with reference to the accompanying drawings, in which.

MORE DETAILED DESCRIPTION

Figure 1:
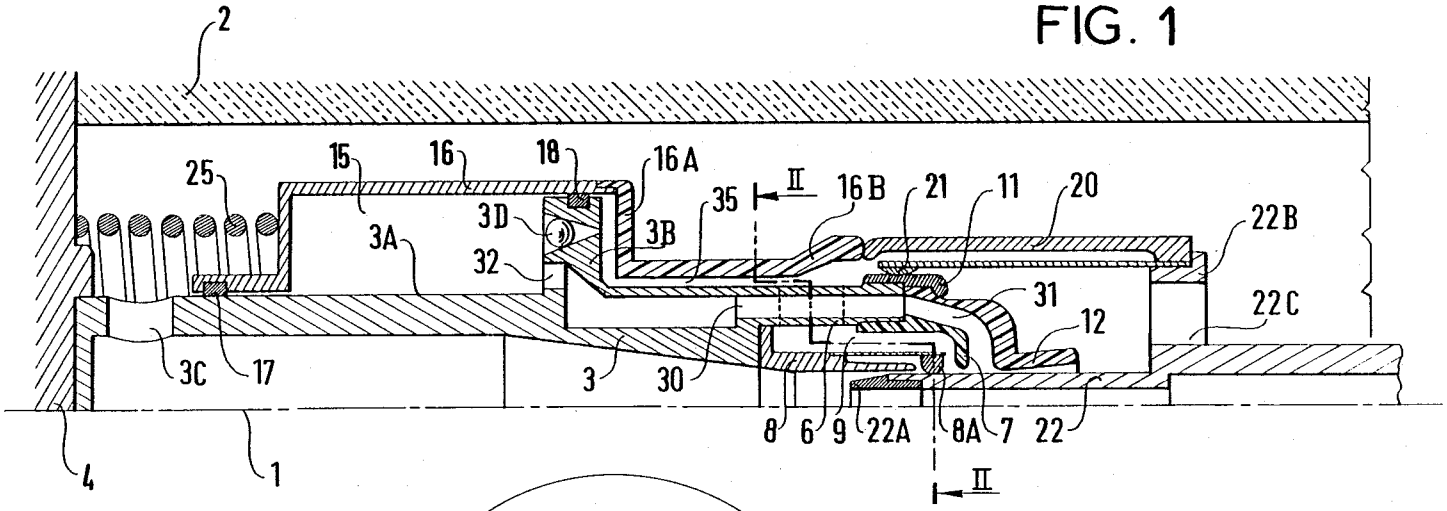
FIG. 1 is a fragmentary axial half-section view of the interrupting chamber of a circuit breaker made in accordance with the present invention and shown in its closed position
Figure 2:
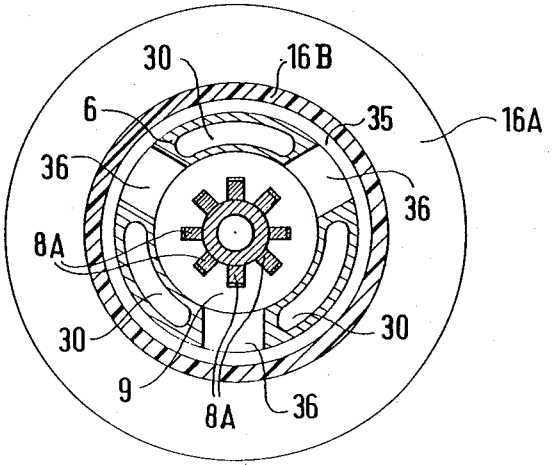
FIG. 2 is a section of line II—II of FIG. 1.

In FIG. 1, reference 1 designates the axis of a circuit breaker. The circuit breaker comprises a sealed insulating envelope 2 filled with a dielectric gas such as sulfur hexafluoride, at a pressure of a few bars.

Inside the envelope, there is a fixed assembly comprising a substantially tubular metal assembly 3 connected to a fixed block 4 which is electrically connected to one of the terminals of the circuit breaker (not shown). The projecting end of the tube 3 has a thin-walled portion 6 terminated by a portion 7 which is insulating or made of a metal capable of withstanding arcing. A tube 8 has arcing contact fingers 8A fixed thereto and defines a thermal volume 9 in conjunction with the tube 6 and the insulating or metal portion 7.

The projecting end of the tube 3 is also fitted with an insulating blast nozzle 12 and with a metal portion 11 constituting the main fixed contact of the circuit breaker.

The blast volume 15 of the circuit breaker is delimited by a portion 3A of the outside surface of the tube 3, by a semi-moving cylinder 16, and by a ring 3B surrounding the tube 3 and constituting a piston. The ring 3B and the tube 3 preferably constitute a single integral member formed by machining.

Gaskets 17 and 18 seal the volume 15 and guide the cylinder 16.

The piston 3B thus divides the cylinder 16 into two chambers: one of the chambers, 15, constituting the blast volume, and the other chamber being referenced 35. The chamber 35 is delimited by the cylinder 16, the piston 3B, the tube 3, and the end of the cylinder 167A. The cylinder 16 is extended by an insulating cylindrical portion 16B which, when the circuit breaker is in its closed position, abuts against a cap 20 which constitutes a part of the moving assembly. The moving assembly also includes main contact fingers 21 and a tube 22 whose end 22A constitutes the moving arcing contact of the circuit breaker The cap 20 and the fingers 21 are fixed to a ring 22B which is machined from the tube 22.

The tube 22 is connected to displacement means which are not shown. When the circuit breaker is in its closed position, the cap 20 pushes against the cylinder 16 and compresses a spring 25.

The blast volume 15 communicates with the arcing zone via channels such as 30 provided through the thickness of the tube 3 and opening out at one end into the annular space 31 lying between the insulating portions 7 and 12, and at the other end into the volume 15 via openings 32 made through the piston 3B.

The volume 35 communicates via passages 36 through the thickness of the tube 3 with the thermal volume 9. It may be observed that the channels 30 and the passages 36 do not comunicate with one another so that the hot gas in the thermal volume 9 and the cold gas in the blast volume 15 cannot mix.

Finally, it should be noted that the piston 3B is provided with a non-return valve 3D which allows gas to flow into the volume 15, but not out therefrom.

The circuit breaker operates as follows:

In the closed or current-conveying position (FIG. 1), electrical current flows along the block 4, the tube 3, the contacts 11 and 21, and the tube 22.

Figure 3:
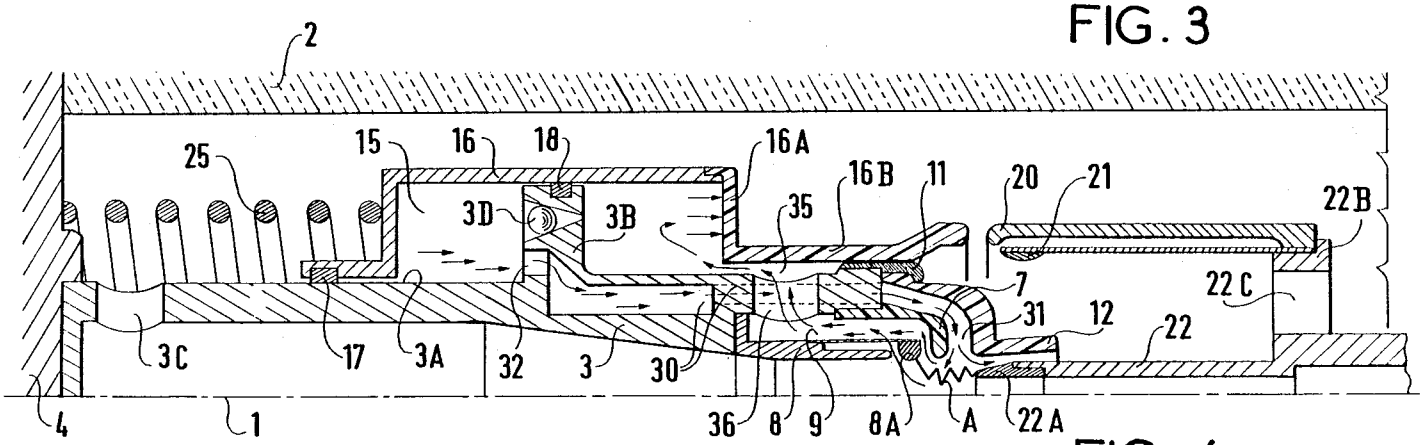
FIG. 3 is a view of the same chamber during an opening or interrupting maneuver.

When the circuit breaker is opened, the moving assembly is displaced towards the left of the figure. The main contacts 11 and 21 separate first and the current then flows via the arcing contacts 8A and 22A. When the arcing contacts separate (FIG. 3) an arc A is struck between them. The cap 20 ceases to be in abutment against the tube 16A and the semi-moving equipment (i.e. the cylinder 16) moves towards the right of the figure, under the action of the spring 25.

The volume 15 is compressed and cold gas is propelled via the channels 30 and the volume 31 onto the arc A.

Simultaneously, the arc A heats the gas in the volume 9. The pressure of this gas rises, and the increased pressure thrusts against the end of the cylinder 16A via the passages 36 and the volume 35, thereby further increasing the pressure in the blast volume 15.

Figure 4:
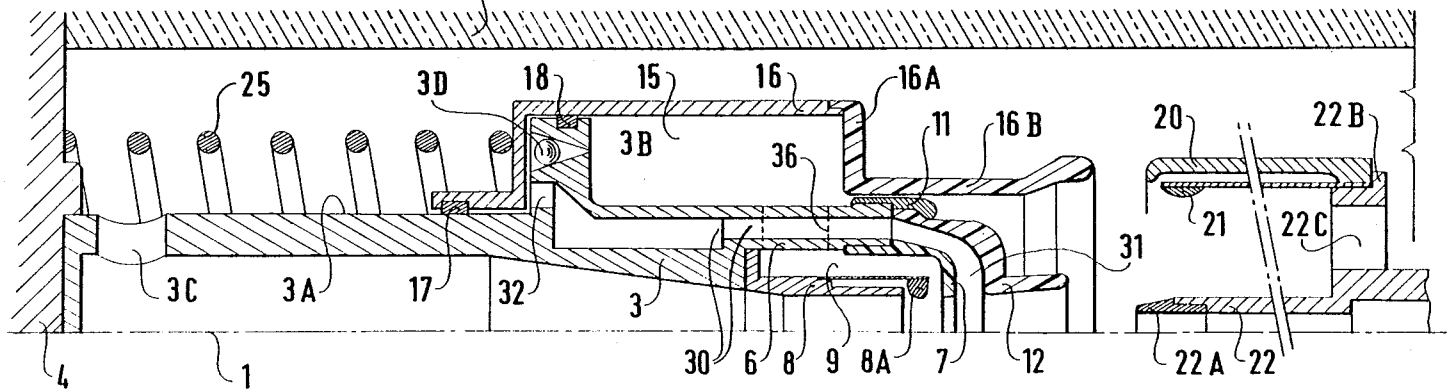
FIG. 4 is a view of the same chamber when fully open.

At the end of the maneuver (FIG. 4) the volume 15 is reduced to zero. The gases escape via the holes 3C and 22C. When the circuit breaker is re-closed, the non-return valve 3D opens, thereby facilitating re-filling the blast volume 15.

The above-described dispositions confer considerable advantages to the circuit breaker, namely:

(a) the arc-blasting gas remains cold, and its dielectric performance is not reduced by being mixed with hot gas; and (b) if the arc is small (interrupting nominal current), the energy stored in the spring is sufficient for compressing the blast volume; whereas if the arc is large (interrupting short-circuit current) the energy from the arc contributes to forcibly displacing the semi-moving equipment to compress the blast volume: the higher the current to be interrupted, the greater the amount of thermal energy delivered by the arc and thus the greater the blast pressure; and (c) the energy required for maneuvering the moving assembly remains independent from the current to be interrupted.

Figure 5:
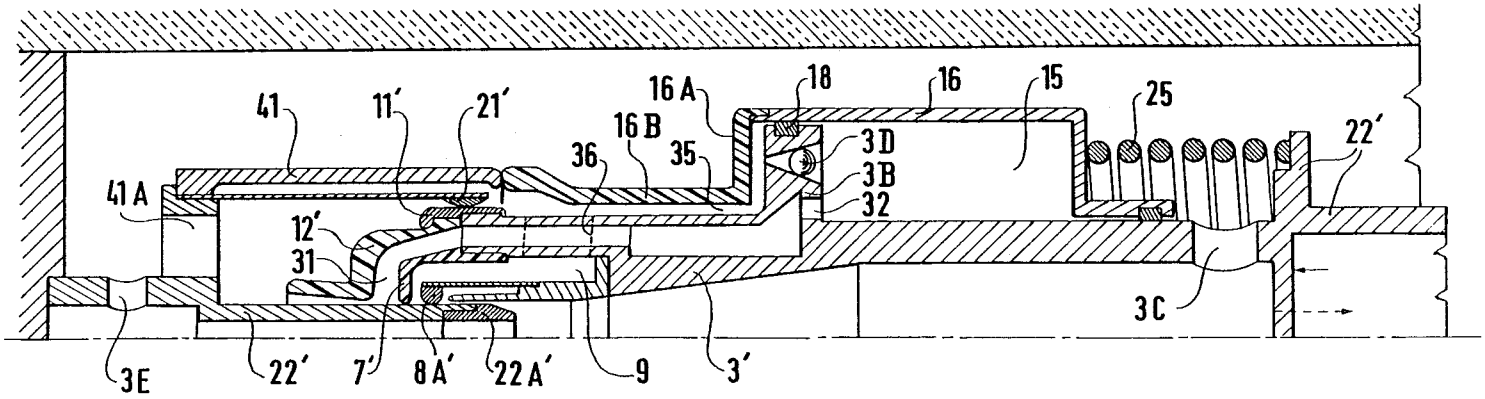
FIG. 5 is a fragmentary axial half section of the interrupting chamber of a variant circuit breaker.

FIG. 5 shows that the semi-moving equipment may be disposed on the moving assembly. The elements in this figure which are common to the preceding figures have the same reference numerals plus a prime (′), and the references of the fixed and the moving assemblies have been interchanged.

A fixed tube 41 serving as an abutment for the semi-moving equipment is added to the tube 3′.

The spring 25 then abuts against a ring 22′ forming a part of the tube 22.

Holes 3E, 41A and 3C allow the gases to dissipate after an opening maneuver of the circuit breaker.

Figure 6:
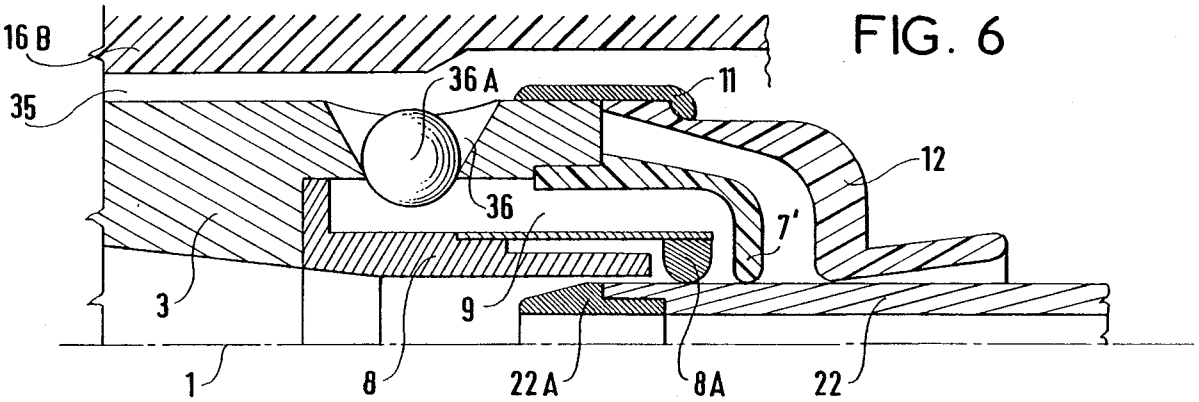
FIG. 6 is an enlarged view of a variant embodiment of the thermal volume.

FIG. 6 shows a variant embodiment in which the passages 36 are closed by non-return valves such as 36A that open only to allow gas to pass from the volume 9 into the volume 35. As a result the thermal origin energy contained in the gas heated by the arc remains inside the volume 35 and is fully used in assisting in the compression of the volume 15. In addition, the hot gas does not disturb blasting using the cold gas.

Figure 7:
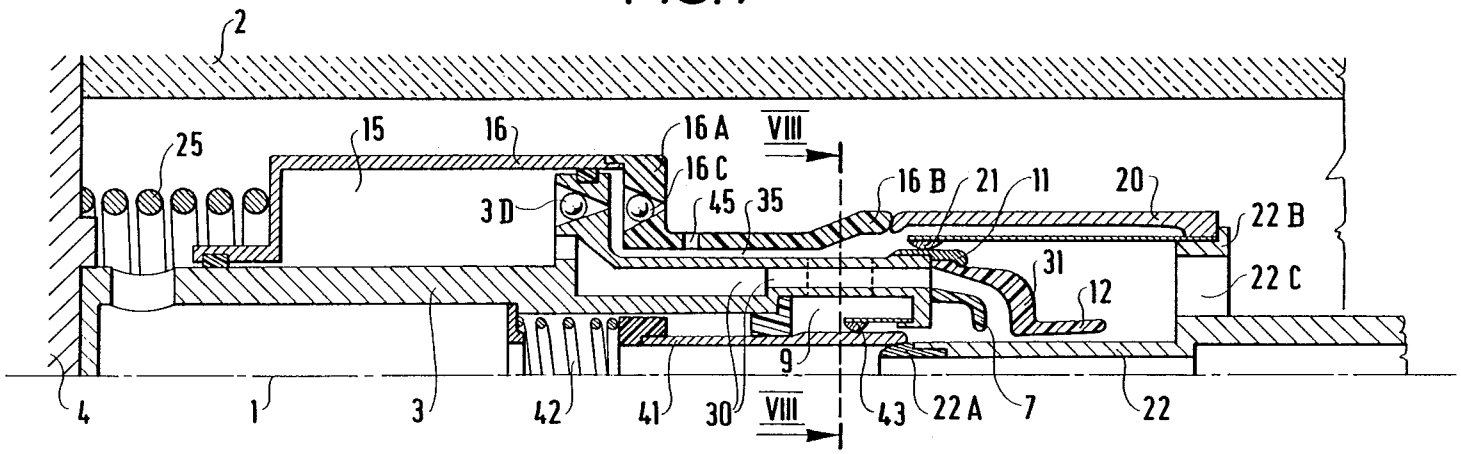
FIG. 7 is a fragmentary axial half-section of the interrupting chamber of a circuit breaker in accordance with another variant embodiment of the invention, and shown in its closed position.
Figure 8:
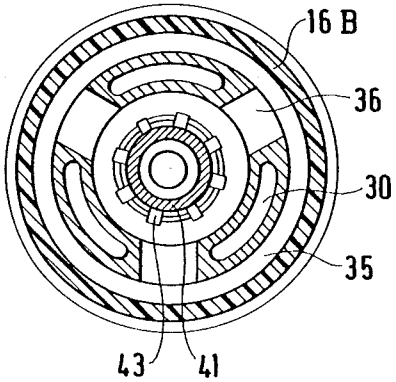
FIG. 8 is a section on line VIII—VIII of FIG. 7.
Figure 9:
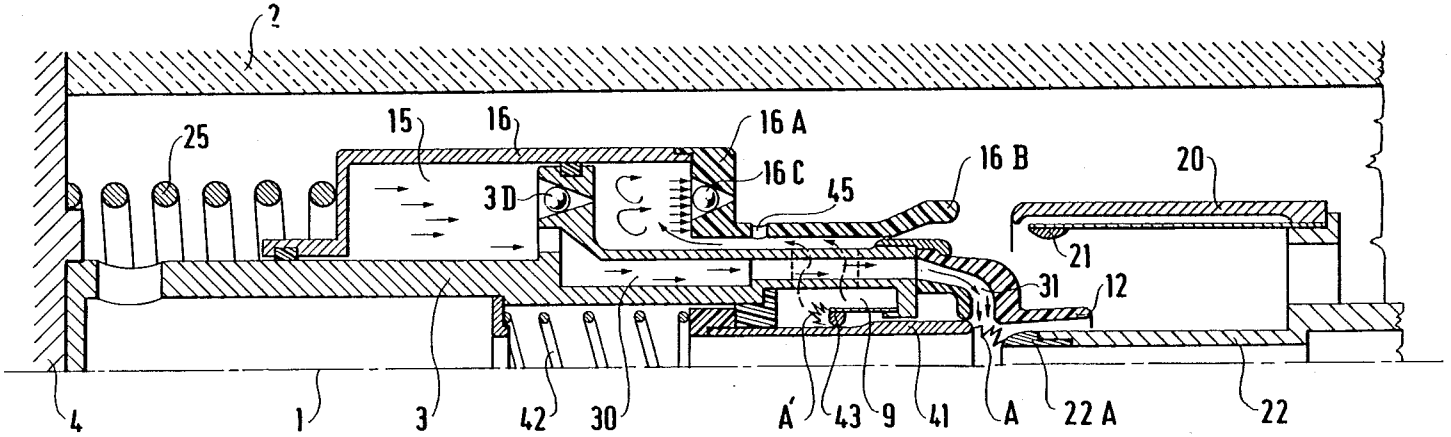
FIG. 9 is a view of the FIG. 7 chamber during an opening maneuver.

FIGS. 7 to 9 show a variant embodiment of the invention. Elements in common with those shown in FIGS. 1 to 4 have the same reference numerals.

The interrupting chamber includes a semi-moving, tubular arcing contact 41. The term "semi-moving" is used to indicate that the item in question is capable of moving to a certain extent relative to a reference member, and in this case relative to the tube 3.

In the closed position of the circuit breaker, the contact 41 compresses a spring 42 since it is pushed by the moving contact 22.

The contact 41 closes the thermal volume 9. A ring of contact fingers 43 is disposed in this volume, and the fingers press lightly on the tube 41. These fingers are mechanically and electrically fixed to the fixed tube 3.

Finally, it may be observed that the end of the cylinder 16A includes a non-return valve 16C whose function is explained below.

The circuit breaker operates as follows:

(a) Interrupting a low current:

As the moving assembly moves during an interrupting opening operation, the fingers 43 remain in contact with the tube 41 since they are lightly pressed thereagainst.

No arcing occurs between the fingers 43 and the tube 41, and the energy in the spring 25 is sufficient to provide the pressure required for blasting the arc which is struck between the tube 41 and the tube 22.

(b) Interrupting a high current:

Because of the considerable electrodynamic forces acting on the fingers 43, they move slightly away from the tube 41. A primary arc A′ (see FIG. 9) is struck between the fingers and the tube and sets up a very high pressure in the volume 9. This pressure is communicated by the passages 36 to the volume 35 and thus contributes to compressing the blast volume 15 in order to extinguish the arc A.

The greater the value of the current to be interrupted, the greater the thermal energy delivered by the primary arc A′ and thus the greater the active pressure.

At the end of the maneuver, the excess pressure in the volume 9 is eliminated via calibrated holes 45. When the circuit breaker is re-closed, the non-return valve 3D opens, thereby allowing the volume 15 to be filled easily. The non-return valve 16C opens when interrupting low value currents in order to avoid setting up a vacuum in the volume generated by the movement of the tube 16. When interrupting a high current, the pressure due to the arc ensures that this non-return valve stays closed.

Figure 10:
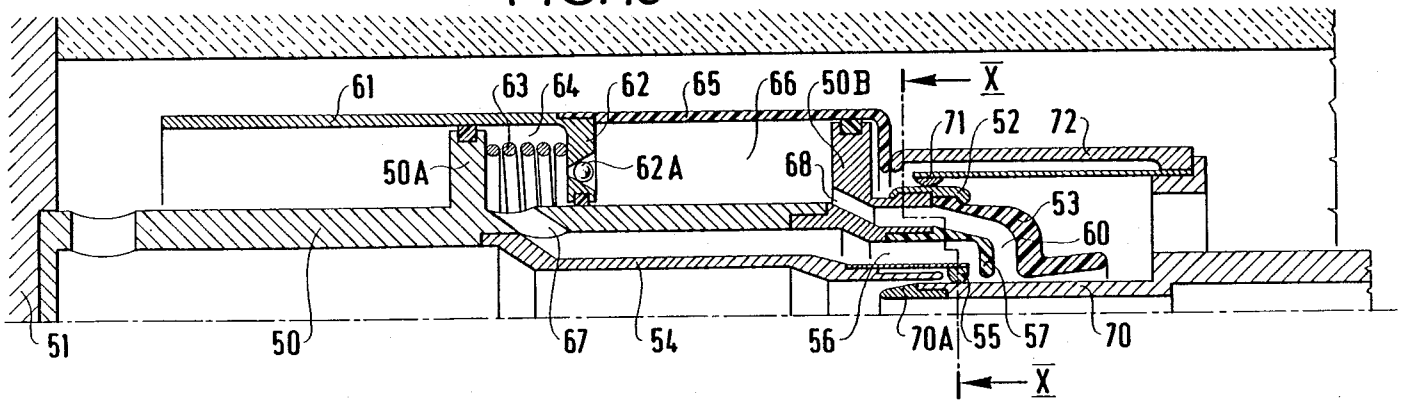
FIG. 10 is a fragmentary axial half-section through the interrupting chamber of a circuit breaker in accordance with another variant embodiment of the present invention, and shown in its closed position.
Figure 11:
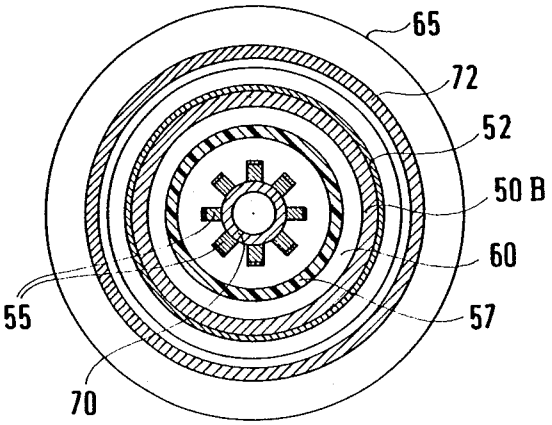
FIG. 11 is a section view on line XI—XI of FIG. 10.
Figure 12:
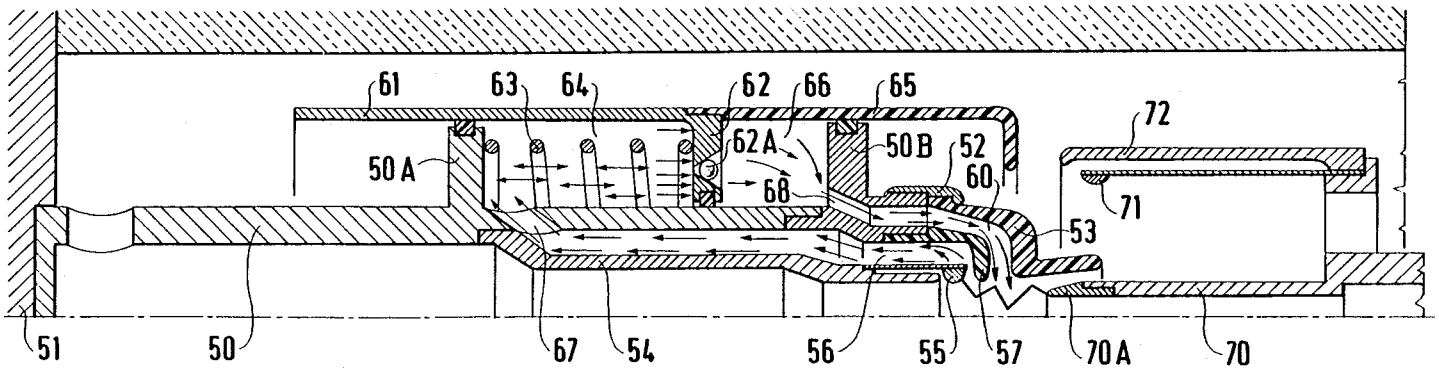
FIG. 12 is a view of the same chamber during an opening maneuver.

FIGS. 10 to 12 show a further embodiment of the invention.

The circuit-breaker chamber comprises a fixed tube 50 connected via a block 51 to a terminal of the circuit breaker (not shown). At its end furthest from the block 51, the tube has a blast nozzle 53 and a portion 52 which constitutes the fixed main contact.

A tube 54 terminated by arcing contact fingers 55 is fixed to the tube 50. The tubes 50 and 54 delimit a thermal volume 56. This chamber is closed by an insulating piece 57 which, together with the nozzle, defines an annular blast channel 60.

A semi-moving cylinder 61 terminated by an end 62 surrounds the tube 50. The tube 61 slides in sealed manner on a first ring 50A (integrally formed with the tube 50 by moulding or by forging).

A spring 63 is disposed between the ring 50A and the end 62. Reference 64 designates the chamber delimited by the items 50, 50A, 61, and 62.

A tubular insulating cap 65 extends the cylinder 61. In conjunction with the end 62, the tube 50 and a second ring 50B, it delimits a blast chamber 66.

The chamber 64 communicates with the thermal volume 56 via passages 67 through the tube 50.

The blast chamber 66 communicates with the annular blast channel via the passages 68.

The moving equipment includes a tube 70 whose end 70A constitutes the moving arcing contact and has contact fingers 61 protected by a cap 72.

The cap 72 co-operates with the cap 75 in order to compress the spring 63 when the circuit breaker is closed.

This circuit breaker operates identically to that described with reference to FIGS. 1 to 4.

When interrupting low value currents, the spring 63 provides all the energy required.

When interrupting high currents (see FIG. 12), the thermal energy of the arc creates excess pressure in the thermal volume 56, which pressure is transmitted from the chamber 56 to the chamber 64 and is then added to the pressure from the spring in order to increase the extent to which the gas in the blast chamber 66 is compressed.

When the circuit breaker is re-closed, a non-return valve 62A opens, thereby facilitating re-filling the chamber 66 with gas.

The invention is applicable to high-tension circuit breakers (i.e. for operation at greater than 45 kV) and to medium-tension circuit breakers.

We claim:

1. A compressed gas dielectric circuit breaker comprising fixed main contacts, fixed arcing contacts, a moving assembly comprising main contacts and arcing contacts, a blast device comprising a semi-moving cylinder divided into first and second chambers by a fixed piston with the first chamber communicating with a blast nozzle, and thermal volume opening out into the zone where the fixed arcing contacts separate from the arcing contacts of the moving assembly, and means for establishing communication between the thermal volume and said second chamber in order to enable gas heated by the arc in the thermal volume to increase in pressure therein and to assist in displacement of the cylinder and thus in the compression of the gas in the first chamber, the semi-moving cylinder sliding over a fixed tube which is coaxial therewith, the fixed contacts being disposed at one end of said tube, the piston being constituted by a ring fixed to said tube, the first chamber communicating with the nozzle via channels through the thickness of the tube and disposed parallel to the axis of the tube, the thermal volume being delimited to the fixed arcing contacts and the outside wall of the tube which has an end portion of reduced wall thickness, and means for establishing communicating between said thermal volume and said second chamber including radial passages provided through the tube and disposed between said channels.

2. A compressed gas dielectric circuit breaker comprising fixed main contacts, fixed arcing contacts, a moving assembly comprising main contacts and arcing contacts, a blast device comprising a semi-moving cylinder divided into first and second chambers by a fixed piston with the first chamber communicating with a blast nozzle, and a thermal volume opening out into the zone where the fixed arcing contacts separate from the arcing contacts of the moving assembly, and means for establishing communication between the thermal volume and said second chamber in order to enable gas heated by the arc in the thermal volume to increase in pressure therein and to assist in the displacement of the cylinder and thus in the compression of the gas in the first chamber, the semi-moving cylinder sliding over a tube forming a portion of the moving assembly, said tube carrying the moving contacts, means for communicating the first chamber with said blast nozzle via channels made through the thickness of the tube and disposed parallel to the axis of the tube, the thermal volume being delimited by the moving arcing contacts and the outside wall of the tube which tube has an end portion of reduced wall thickness, and means for establishing comunication between the thermal volume and the second chamber including radial passages provided through the tube.

3. A circuit breaker according to claim 1 or 2, wherein the radial passages are closable by respective non-return valves allowing gas to flow solely in the direction from the thermal volume towards the second chamber.

4. A compressed gas dielectric circuit breaker comprising fixed main contacts, fixed arcing contacts, a moving assembly comprising main contacts and arcing contacts, a blast device comprising a semi-moving cylinder divided into first and second chambers by a fixed piston with the first chamber communicating with a blast nozzle, and a thermal volume opening out into the zone where the fixed arcing contacts separate from the arcing contacts of the moving assembly, and means for establishing communication between the thermal volume and said second chamber in order to enable gas heated by the arc in the thermal volume to increase in pressure therein and to assist in the displacement of the cylinder and thus in the compression of the gas in the first chamber, said semi-moving cylinder sliding over a fixed tube which is coaxial therewith, the fixed main contacts being disposed at one end of said tube, the piston being constituted by a ring fixed to said tube, means communicating the first chamber with the nozzle via channels made through the thickness of the tube and disposed parallel to the axis of the tube, the thermal volume being delimited by a semi-moving tube constituting one of the arcing contacts, and via the outside wall of the fixed tube, a ring of contact fingers which are mechanically and electrically connected to the fixed tube being disposed inside the thermal volume to press against the semi-moving tube, and means for establishing communication between the thermal volume and the second chamber including radial passages made through the fixed tube and disposed between said channels.

* * * * *